United States Patent [19]

Kojima et al.

[11] Patent Number: 4,753,204

[45] Date of Patent: Jun. 28, 1988

[54] AIR-FUEL RATIO CONTROL SYSTEM FOR INTERNAL COMBUSTION ENGINES

[75] Inventors: Shinji Kojima; Seiji Wataya, both of Himeji; Ryoji Nishiyama, Amagasaki, all of Japan

[73] Assignee: Mitsubishi Denki Kabushiki Kaisha, Japan

[21] Appl. No.: 101,435

[22] Filed: Sep. 28, 1987

[30] Foreign Application Priority Data

Sep. 30, 1986 [JP] Japan ..... 61-233581
Sep. 30, 1986 [JP] Japan ..... 61-233582

[51] Int. Cl.[4] ..... F02D 41/14

[52] U.S. Cl. ..... 123/440; 123/489; 204/425

[58] Field of Search ..... 123/440, 489, 589; 204/424, 425, 426

[56] References Cited

U.S. PATENT DOCUMENTS

| | | | |
|---|---|---|---|
| 4,332,225 | 6/1982 | Cox et al. | 204/424 X |
| 4,464,244 | 8/1984 | Uchida et al. | 204/426 X |
| 4,500,412 | 2/1985 | Takahashi et al. | 204/425 |
| 4,541,899 | 9/1985 | Mase et al. | 204/425 X |
| 4,594,987 | 6/1986 | Wataya et al. | 123/494 |
| 4,611,562 | 9/1986 | Nakano et al. | 123/440 |
| 4,639,305 | 1/1987 | Shibata et al. | 204/426 |
| 4,650,560 | 3/1987 | Ueno | 204/425 X |
| 4,683,539 | 7/1987 | Kanno et al. | 364/431.05 |
| 4,694,806 | 9/1987 | Wataya et al. | 123/494 |
| 4,706,634 | 11/1987 | Nishikawa et al. | 123/492 |
| 4,715,343 | 12/1987 | Kinoshita | 123/489 |

FOREIGN PATENT DOCUMENTS

| | | |
|---|---|---|
| 0125553 | 7/1985 | Japan. |
| 0235045 | 11/1985 | Japan. |

*Primary Examiner*—Willis R. Wolfe
*Attorney, Agent, or Firm*—Leydig, Voit & Mayer

[57] ABSTRACT

An air-fuel ratio control system for internal combustion engines has an air-fuel ratio sensor mounted in an exhaust pipe of an internal combustion engine and is adapted to produce an output indicative of the air-fuel ratio of a mixture supplied to the engine, on the basis of the composition of exhaust gases in the exhaust pipe. The air-fuel ratio sensor is provided with an electric heater for heating the air-fuel ratio sensor. The system further has a temperature sensor for sensing the temperature of the internal combustion engine or the ambient air temperature, and an engine operation sensor adapted to sense whether the engine has been stopped, through detection of the state of the ignition switch. When the engine operation sensor has sensed that the internal combustion engine has been stopped while the temperature sensed by the temperature sensor is below a predetermined level, the electric heater is supplied with power for a predetermined time after the stop of the engine so as to evaporate any water content clinging to the air-fuel ratio sensor.

10 Claims, 4 Drawing Sheets

AIR-FUEL RATIO CONTROL SYSTEM FOR INTERNAL COMBUSTION ENGINES

BACKGROUND OF THE INVENTION

1. Field of the Invention

The present invention relates to an air-fuel ratio control system for internal combustion engines and, more particularly, to an air-fuel ratio control system in which the feed-back control of the air-fuel ratio of a mixture supplied to an internal combustion engine is conducted in accordance with a signal from an air-fuel ratio sensor with a heater. Still more particularly, the invention is concerned with an air-fuel ratio control system of the type mentioned above, which is improved to prevent destruction of the air-fuel ratio sensor when the ambient air temperature is low.

2. Description of the Prior Art

A feed-back type air-fuel control system has been known which employs an air-fuel ratio sensor (oxygen sensor) in which the output is inverted when the air-fuel ratio changes across the stoichiometric point. In order for this type of air-fuel ratio control system to operate satisfactorily, it is essential that the air-fuel ratio sensor is well activated by being heated to and maintained at a high temperature. In some cases, however, this requirement cannot be met particularly when the exhaust gas temperature is comparatively low due to light loads on the engine or when the air-fuel ratio sensor is installed at the downstream portion of the exhaust pipe. In order to obviate this problem, air-fuel control systems have been proposed and actually used in which the air-fuel ratio sensor incorporates an electric heater which heats and activates the sensor.

Air-fuel ratio sensors adapted to produce a digital output which changes linearly in response to a change in the air-fuel ratio have also been put into practical use. Such sensors also incorporate electric heaters for the purpose of improving the sensing accuracy and sufficiently activating the sensors.

Air-fuel ratio control systems using air-fuel ratio sensors of the types mentioned above are broadly used in various internal combustion engines for the purpose of cleaning exhaust gases, regardless of whether the engines are carbureted or fuel injected.

A known air-fuel ratio control system combined with speed-density-type fuel injection and employing an air-fuel ratio sensor adapted to produce a linear output in relation to a change in the air-fuel ratio will be described hereunder by way of example.

The description will be made with reference to FIG. 3 which also will be used in the description of an embodiment of the invention.

Referring to the drawings, an internal combustion engine A has an engine proper 1, an intake pipe 2 and a throttle valve 3 disposed in the intake pipe 2.

The pressure of the intake air in the intake pipe 2 is sensed by a pressure sensor 4 which delivers the sensing output to an A/D converter 91 of a later-mentioned control device 9. The temperature of the engine proper 1 is detected by a cooling water temperature sensor 10 the output of which also is delivered to the A/D converter 91.

The engine speed is sensed by an rpm sensor 5 which produces pulses of a frequency proportional to the engine speed. The output pulses of the rpm sensor are delivered to an input circuit 92 of the control device 9. The control device 9 has an output circuit 96 which delivers a control output in accordance with which a fuel injector 6 operates to inject a fuel into the intake pipe 2.

An air-fuel ratio sensor 8 is disposed in an exhaust pipe 7 which is connected to the engine proper 1. The air-fuel ratio sensor is capable of sensing the air-fuel ratio of the mixture fed to the engine through measurement of components of the exhaust gas flowing in the exhaust gas pipe 7.

Thus, the control device 9 receives various data concerning the state of engine operation, including the intake air pressure data derived from the pressure sensor 4, engine speed data from the rpm sensor 5 and the air-fuel ratio from the air-fuel ratio sensor 8. Upon receipt of these data, the control device 9 computes the optimum fuel injection rate and controls the duty ratio or the pulse width of the driving pulses for driving the fuel injector 6 in accordance with the thus computed optimum fuel injection rate.

The AD converter 91 of the control device 9 is adapted to convert the analog signals such as those derived from the air-fuel ratio sensor 8 and the pressure sensor 4 into digital signals which are delivered to a microprocessor 93.

The input circuit 92 of the control device 9 has a function to conduct a level-conversion of the pulse signal derived from the rpm sensor 5. The signal from this circuit 92 also is delivered to the microprocessor 93. The microprocessor 93 computes the amount of fuel to be supplied to the engine proper 1 in accordance with the digital and pulse signals from the AD converter 91 and the input circuit 92, to produce a signal for controlling the duty ratio or the pulse width of the driving pulses for driving the injector 6.

The processes to be executed by the microprocessor 93 and other related data are stored beforehand in a read-only memory (ROM) 94, while data obtained in the course of computation are temporarily stored in a random access memory (RAM) 95. The delivery of the output signal from the microprocessor 93 to the fuel injector 6 is conducted through the output circuit 96.

The construction of the air-fuel ratio sensor 8 will be described hereunder with reference to FIG. 4. Specifically, the air-fuel ratio sensor 8 has an oxygen pump cell 81, an oxygen battery cell 82, a pair of electrodes **83*a*, 83*b* made of a porous material, a diffusion chamber 84, a reference voltage 85, a comparison amplifier 86, a pump driving circuit 87, and a resistor 88** which is used for the purpose of detecting the electric current in the pump cell.

Reference numeral 103 denotes an electrical insulator on which is formed a resistor 100. The resistor 100 serves as a heat-generating element. An air gap 102 is formed between the portion of the electric insulator 103 having the resistor 100 and the oxygen battery cell 82. This basic arrangement of the air-fuel ratio sensor 8 is already known from the disclosures of Japanese Patent Laid-Open Nos. 59-19046 and 60-128349. In operation, the voltage generated in the oxygen battery cell 82 and the voltage of a reference voltage source 85 which is set, for example, at 0.4 V are input to the comparison amplifier 86 so as to be compared with each other. At the same time, the pump driving circuit 87 is driven to supply an electric current to the oxygen pump cell 81 so as to reduce the offset of the voltage in the oxygen battery cell 82 from the reference voltage to zero, whereby a state of the exhaust gas corresponding to the stoichiometric ratio is obtained in the diffusion chamber 84.

With this arrangement, it is possible to detect the air-fuel ratio of the mixture which is being fed to the engine, regardless of whether it is on the leaner or richer side of the stoichiometric point, and the result of measurement is taken out as a voltage across the resistor 88. In consequence, an output voltage which linearly changes in relation to a change in the air-fuel ratio over a wide range is obtained as shown in FIG. 5.

During operation of the engine, the resistor 100 is supplied with an electric current through the output circuit 97 in the control device 9 so as to heat and activate the air-fuel ratio sensor 8.

A description will be made hereunder with specific reference to FIG. 6 as to a typical known feed-back control of air-fuel ratio conducted by using the above-described air-fuel ratio sensor 8. FIG. 6 is a flow chart showing the process of the control performed by the control device 9 shown in FIG. 3.

The pulse signal from the rpm sensor 5, representing the rpm Ne of the engine, is read in Step S 1, and the signal from the pressure sensor 4 indicative of the absolute pressure Pb in the intake pipe is read in Step S 2. In Step S 3, the basic driving pulse width $r_o$ of the pulses for driving the injector 6 is computed on the basis of the data read in Steps S 1 and S 2.

The pulse width $r_o$ can be expressed by $r_o = K \cdot Pb \cdot \eta_v$, where K represents a constant, while $\eta_v$ represents charging efficiency which is determined by the intake pressure Pb and the engine rpms Ne. Although not shown in FIG. 6, a temperature-compensation is conducted on the driving pulse width in accordance with the temperature signal derived from the cooling water temperature sensor 10 such that the actual driving pulse width $\tau_o$ is increased as compared with that computed by the above-mentioned formula when the cooling water temperature is low.

A target air-fuel ratio (A/F) S is set in Step S 4. The target air-fuel ratio (A/F) S is determined beforehand in such a manner as to optimize the air-fuel ratio for attaining the maximum dynamic performance of the engine while minimizing the fuel consumption under varying engine rpms Ne and the intake pressure Pb, as will be seen from FIG. *7a* which shows operation cycle of the engine and FIG. *7b* which shows the on-off cycle of the heater in the air-fuel ratio sensor. The target air-fuel ratio, however, may be determined taking into account also other factors such as the engine temperature and the state of acceleration or deceleration of the engine.

The output signal (A/F) R from the air-fuel ratio sensor 8 is read in Step S 5 and, in Step S 6, the deviation of the air-fuel ratio from the target air-fuel ratio, i.e., (A/F)S −(A/F)R, is computed and integrated with a suitable gain. In Step S 7, it is determined whether the integrated value I falls within a predetermined limit range I(LMT). If this integrated value falls within a predetermined range, a correction value $I_1$ is set as $I_1 = I$ in Step S 8, whereas, if this integrated value does not fall within a predetermined range, a correction value $I_1$ is set as $I_1 = IL$ in Step S 9.

In Step S 10, the pulse width r of the injector driving pulses is determined by multiplying the basic pulse width $r_0$ determined in Step S 3 with the correction value $I_1$ determined in Step S 8 or S 9.

It will be understood that the feed-back control of the air-fuel ratio is conducted to follow the target air-fuel ratio as the above-described control process is repeated momentarily.

The described control operation, however, essentially requires that the air-fuel ratio sensor 8 correctly detect momentary changes in the air-fuel ratio and, therefore, the air-fuel ratio sensor has to be sufficiently activated by being heated. However, exhaust gas temperature is normally so low when the engine is operating under a light load that the air-fuel ratio sensor 8 cannot be sufficiently activated. In order to obviate this problem, it has been a common measure to provide an electric heater 100 in the air-fuel ratio sensor 8 and to supply electric power to the heater 100 whenever the engine is operating, as shown in FIGS. *7a* and *7b*.

The known air-fuel ratio control system for internal combustion engines described hereinabove can operate satisfactorily under normal ambient air temperature. A problem is encountered, however, particularly when the ambient air temperature is extremely low, e.g., between 0° and −30° C. Namely, under such low ambient air temperatures, if the engine is stopped before the engine and the exhaust system are completely heated, the moisture contained in the exhaust gas condenses within the exhaust pipe 7 to become water droplets which cling to the air-fuel ratio sensor.

The air-fuel ratio sensor 8 has tiny apertures such as the air gap 102 and very small holes formed in the electrodes 83*a*, 83*b*. If the engine is left to stand without operating under such cold temperatures, the water droplets clinging to such tiny apertures fleeze, increasing their volumes to produce mechanical forces which break the cells in the air-fuel ratio sensor 8.

SUMMARY OF THE INVENTION

Accordingly, it is an object of the present invention to provide an air-fuel ratio control system for internal combustion engines, which is improved in such a way as to prevent destruction of the air-fuel ratio sensor attributable to freezing of water droplets, thereby overcoming the above-described problems of the prior art.

To this end, according to one aspect of the present invention, there is provided an air-fuel ratio control system for internal combustion engines, comprising: an air-fuel ratio sensor mounted in an exhaust pipe of an internal combustion engine and adapted to produce an output indicative of the air-fuel ratio of a mixture supplied to the engine on the basis of the composition of exhaust gases in the exhaust pipe; heating means for heating the air-fuel ratio sensor; a temperature sensor for sensing the temperature of the internal combustion engine; an engine operation sensor adapted to sense whether the engine has been stopped; and control means for allowing, when the engine operation sensor has sensed that the internal combustion engine has been stopped while the engine temperature sensed by the temperature sensor is below a predetermined level, the heating means to operate for a predetermined time after the engine operation sensor has sensed that the internal combustion engine has been stopped.

According to another aspect of the present invention, there is provided an air-fuel ratio control system for internal combustion engines, comprising: an air-fuel ratio sensor mounted in an exhaust pipe of an internal combustion engine and adapted to produce an output indicative of the air-fuel ratio of a mixture supplied to the engine on the basis of the composition of exhaust gases in the exhaust pipe; heating means for heating the air-fuel ratio sensor; a temperature sensor for sensing the temperature of the ambient air; an engine operation sensor adapted to sense whether the engine has been stopped; and control means for allowing, when the engine operation sensor has sensed that the internal combustion engine has been stopped while the ambient air temperature sensed by the temperature sensor is below a predetermined level, the heating means to operate for a predetermined time after the engine operation sensor has sensed that the internal combustion engine has been stopped.

The above and other objects, features and advantages of the present invention will become clear from the following description of the preferred embodiments taken in conjunction with the accompanying drawings.

DESCRIPTION OF THE PREFERRED EMBODIMENTS

Figure 1:
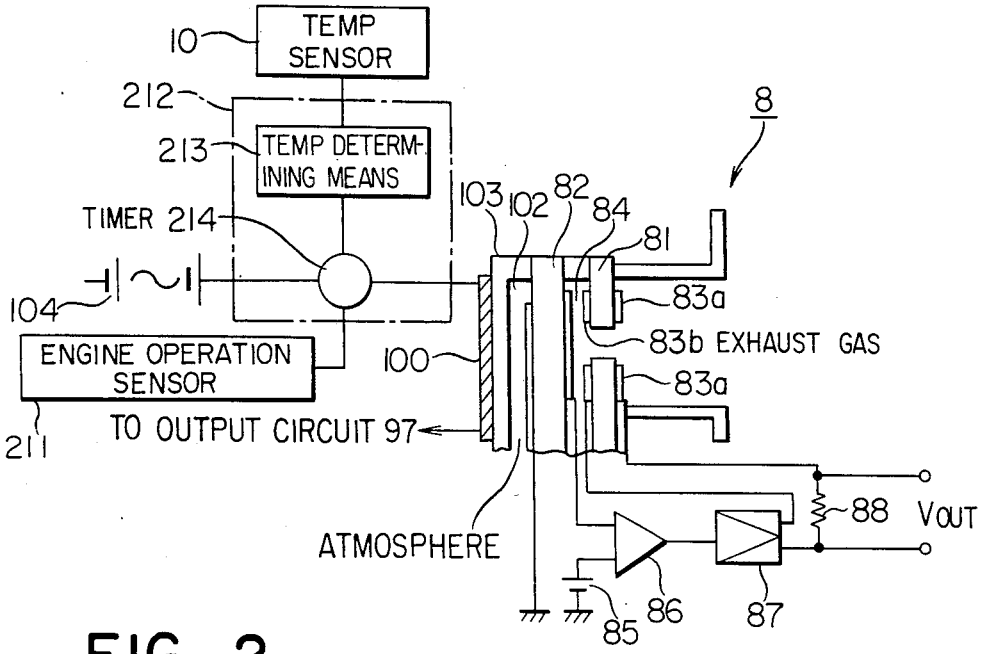
FIG. 1 is a schematic illustration of a critical portion of an air-fuel ratio control system for internal combustion engines in accordance with the present invention.

Preferred embodiments of the present invention will be described hereinunder. In the following description and the associated figures of the drawings, the same reference numerals are used to denote the same parts or members as those appearing in the foregoing description of the prior art.

Figure 3:
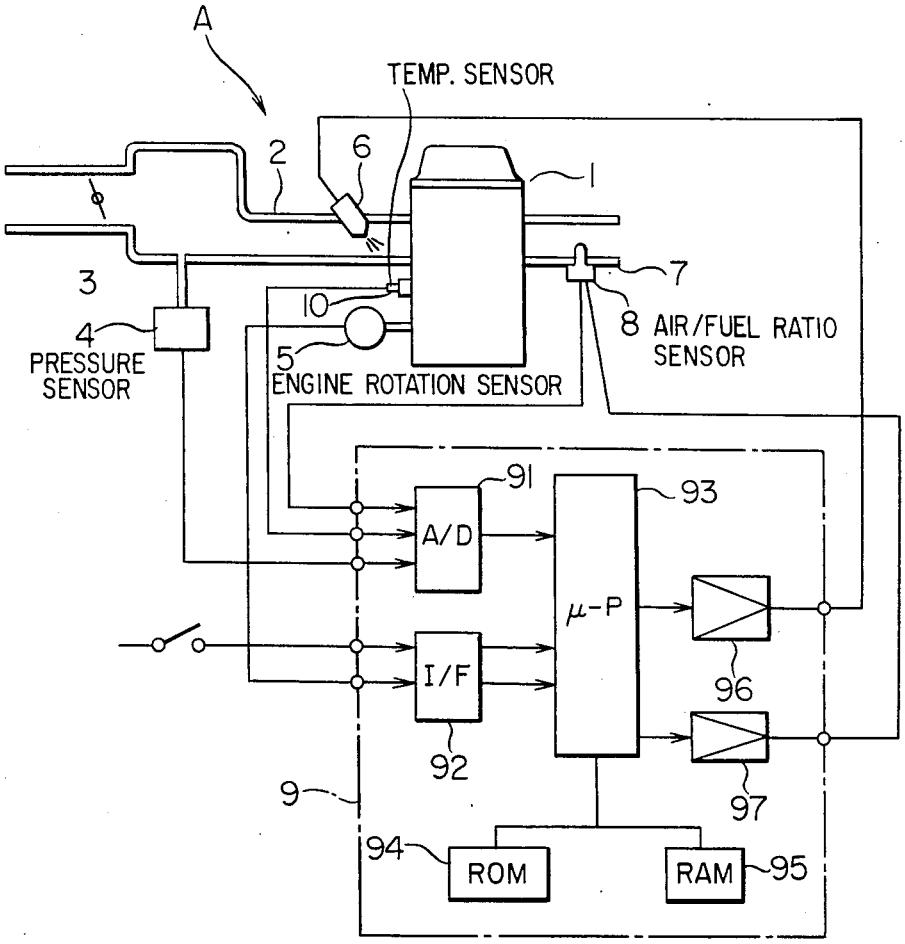
FIG. 3 PRIOR ART
FIG. 3 is a schematic illustration of a known air-fuel ratio control system for internal combustion engines.
Figure 4:
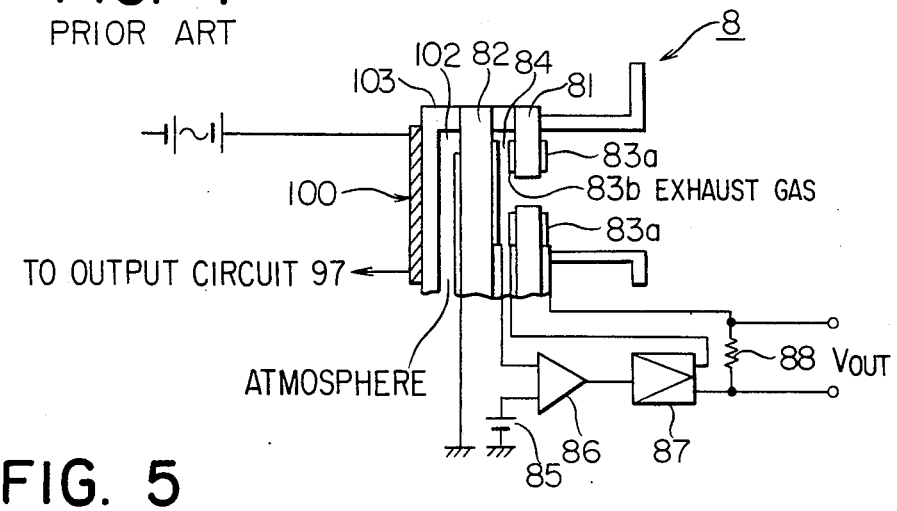
FIG. 4 PRIOR ART
FIG. 4 is an illustration of the construction of an air-fuel ratio sensor.
Figure 5:
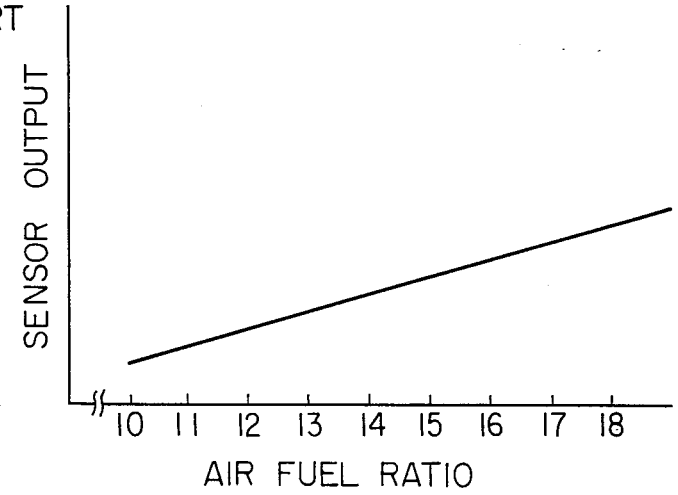
FIG. 5 PRIOR ART
FIG. 5 is a chart showing the operation characteristics of the air-fuel ratio sensor shown in FIG. 4.
Figure 7A:
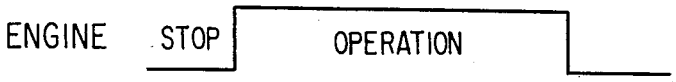
FIG. 7a PRIOR ART
Figure 7B:
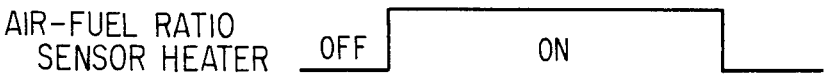
FIG. 7b PRIOR ART
Figure 6:
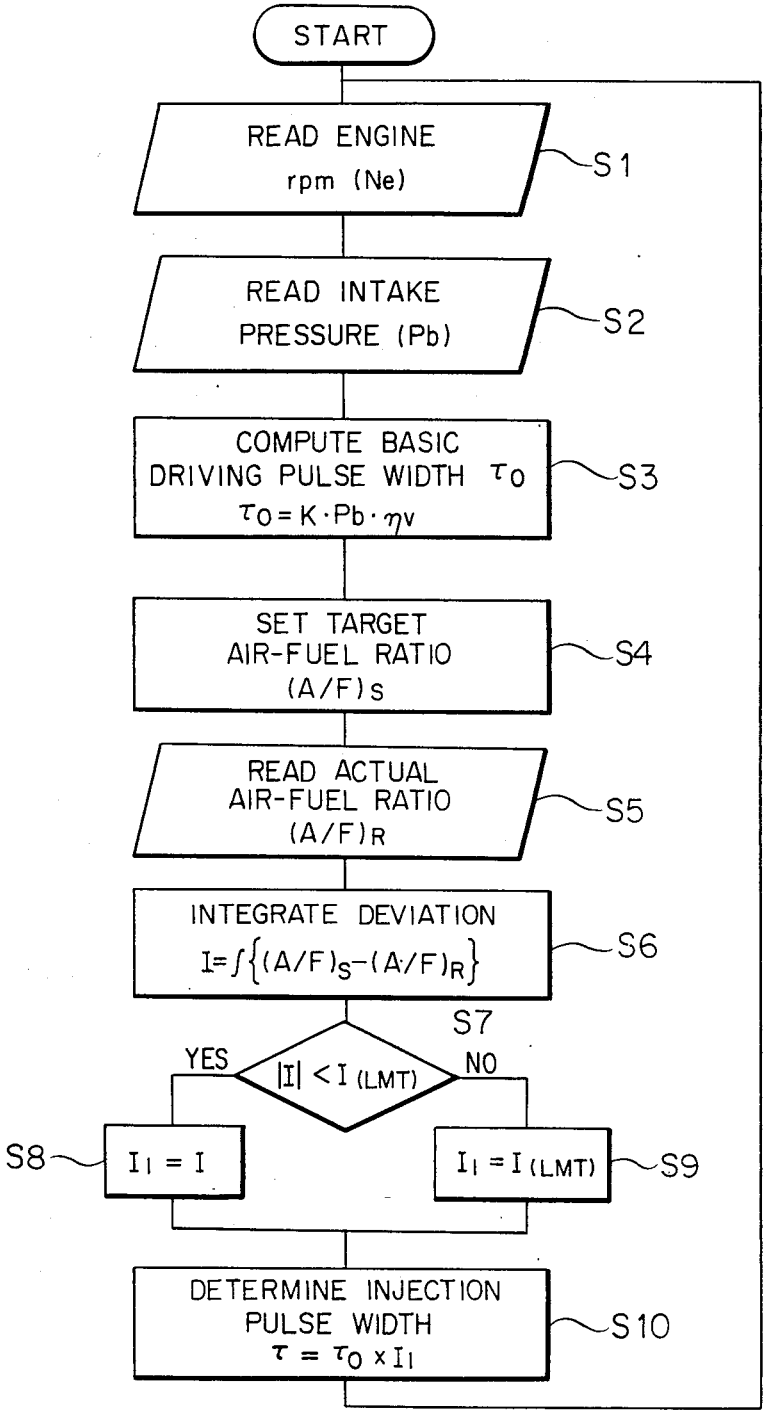
FIG. 6 PRIOR ART
FIG. 6 is a flow chart showing the operation of the known air-fuel ratio control system; and FIGS. *7a* and *7b* are timing charts showing the operation of a heater in the known air-fuel ratio control system in relation to the operation of an internal combustion engine.

The general arrangement of the air-fuel ratio control system of the present invention is basically the same as that of the known system explained before in connection with FIG. 3, but is distinguished from the described known art in that the arithmetic function of the microprocessor 93 in the control device 9 and the manner of setting of data are changed.

Figure 2:
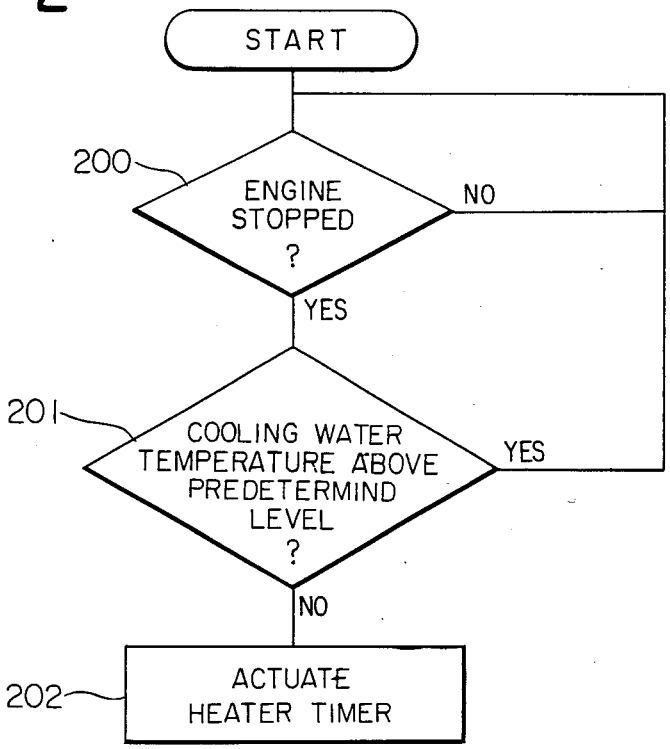
FIG. 2 is a flow chart showing the operation of the air-fuel ratio control system shown in FIG. 1.

More specifically, the air-fuel ratio control system in accordance with the present invention has additional functions as shown in the flow chart in FIG. 2.

Namely, the air-fuel ratio control system embodying the present invention has an air-fuel ratio sensor 8 mounted in an exhaust pipe of an internal combustion engine and adapted to produce an output indicative of the air-fuel ratio of a mixture supplied to the engine on the basis of the composition of exhaust gases in the exhaust pipe; heating means 100 such as an electric heater for heating the air-fuel ratio sensor; a temperature sensor 10 for sensing the temperature of the internal combustion engine; an engine operation sensor 211 adapted to sense whether the engine has been stopped; and control means 212 for allowing, when the engine operation sensor 211 has sensed that the internal combustion engine has been stopped while the engine temperature sensed by the temperature sensor 10 is below a predetermined level, the heating means to operate for a predetermined time after the engine operation sensor 211 has sensed that the internal combustion engine has been stopped.

Preferably, the control means 212 includes temperature determining means 213 for determining whether the engine temperature sensed by the temperature sensor is below the predetermined level, and a timer 214 adapted to allow, when the engine operation sensor 211 has sensed that the internal combustion engine has been stopped while the engine temperature is judged by the temperature judging means 213 to be below the predetermined level, e.g., 70° C., the heating means to operate for a predetermined time after the engine operation sensor has sensed that the internal combustion engine has been stopped.

The operation of this embodiment will be described hereunder with reference to the flow chart shown in FIG. 2. In Step 200, the engine operation sensor 211 determines whether the engine has been stopped or not, through detection of the state of a key or ignition switch. If the engine has been stopped, the process proceeds to Step 201 in which the temperature determining means 213 determines whether the cooling water temperature is above a predetermined level which is, for example, set at 70° C., by means of the signal derived from the water temperature sensor 10. If the cooling water temperature is below the predetermined level, a timer 214 for controlling the power supply to the heater is started in Step 202. During the operation of the timer 214, electric power is supplied from the power supply 104 to the electric heater 100 in the form of a resistor of the air-fuel ratio sensor 8, through the output circuit 97 of the control device 9 so that the air-fuel ratio sensor 8 is heated. The time set in the timer 214 is determined beforehand and is long enough to ensure that any wetness on the air-fuel ratio sensor is completely removed by evaporation. For instance, the timer 214 is set to continue the electric power supply to the heater for several minutes when the ambient air temperature is low.

As will be understood from the foregoing description, in the air-fuel ratio control system of the present invention, when an internal engine is stopped after a short operation before the engine is fully warmed up, the engine temperature is determined through detection of the cooling water temperature and, if the engine temperature is below a predetermined level, electric power is supplied to the heater 100 of the air-fuel ratio sensor 8 for a predetermined time after the stop of the engine, thereby to completely evaporate any water content attached to the air-fuel ratio sensor 8.

According to the invention, therefore, it is possible to avoid destruction of the air-fuel ratio sensor 8 which may otherwise be caused due to freezing of water droplets clinging to the air-fuel ratio sensor when the ambient air temperature is low.

Although in the described embodiment the supply of the electric power to the heater 100 is controlled in accordance with the engine temperature sensed by the cooling water temperature sensor 10, this is not exclusive and the air-fuel ratio control system of the invention may employ a temperature sensor for sensing the ambient air temperature in place of the cooling water temperature sensor 10. In such a case, the temperature determining means 213 determines is below a predetermined level, e.g., 0° C. and, if so, a signal is generated to operate the timer 214 thereby allowing the electric power supply to the heater 100.

Although the invention has been described through its preferred form, it is to be understood that the described embodiment is only illustrative and various changes and modifications may be imparted thereto without departing from the scope of the present invention which is limited solely by the appended claims.

What is claimed is:

1. An air-fuel ratio control system for internal combustion engines, comprising:

an air-fuel ratio sensor mounted in an exhaust pipe of an internal combustion engine and adapted to produce an output indicative of the air-fuel ratio of a mixture supplied to said engine on the basis of the composition of exhaust gases in said exhaust pipe;

heating means for heating said air-fuel ratio sensor;

a temperature sensor for sensing the temperature of said internal combustion engine;

an engine operation sensor adapted to sense whether said engine has been stopped; and control means for allowing, when said engine operation sensor has sensed that said internal combustion engine has been stopped while the engine temperature sensed by said temperature sensor is below a predetermined level, said heating means to operate for a predetermined time after said engine operation sensor has sensed that said internal combustion engine has been stopped.

2. An air-fuel ratio control system for internal combustion engines according to claim 1, wherein said control means includes temperature determining means for determining whether the engine temperature sensed by said temperature sensor is below said predetermined level, and a timer adapted to allow, when said engine operation sensor has sensed that said internal combustion engine has been stopped while the engine temperature is determined by said temperature determining means to be below said predetermined level, said heating means to operate for a predetermined time after said engine operation sensor has sensed that said internal combustion engine has been stopped.

3. An air-fuel ratio control system for internal combustion engines according to claim 1, wherein said heating means comprises an electric heater.

4. An air-fuel ratio control system for internal combustion engines according to claim 3, wherein said timer controls the length of time of electric power supply to said electric heater.

5. An air-fuel ratio control system for internal combustion engines according to claim 1, wherein said engine operation sensor senses that said engine has been stopped, upon detecting turning off of the ignition switch of said engine.

6. An air-fuel ratio control system for internal combustion engines, comprising:

an air-fuel ratio sensor mounted in an exhaust pipe of an internal combustion engine and adapted to produce an output indicative of the air-fuel ratio of a mixture supplied to said engine on the basis of the composition of exhaust gases in said exhaust pipe;

heating means for heating said air-fuel ratio sensor;

a temperature sensor for sensing the temperature of ambient air;

an engine operation sensor adapted to sense whether said engine has been stopped; and control means for allowing, when said engine operation sensor has sensed that said internal combustion engine has been stopped while the ambient air temperature sensed by said temperature sensor is below a predetermined level, said heating means to operate for a predetermined time after said engine operation sensor has sensed that said internal combustion engine has been stopped.

7. An air-fuel ratio control system for internal combustion engines according to claim 1, wherein said control means includes temperature determining means for determining whether the ambient air temperature sensed by said temperature sensor is below said predetermined level, and a timer adapted to allow, when said engine operation sensor has sensed that said internal combustion engine has been stopped while the ambient air temperature is determined by said temperature determining means to be below said predetermined level, said heating means to operate for a predetermined time after said engine operation sensor has sensed that said internal combustion engine engine has been stopped.

8. An air-fuel ratio control system for internal combustion engines according to claim 1, wherein said heating means comprises an electric heater.

9. An air-fuel ratio control system for internal combustion engines according to claim 3, wherein said timer controls the length of time of electric power supply to said electric heater.

10. An air-fuel ratio control system for internal combustion engines according to claim 1, wherein said engine operation sensor senses that said engine has been stopped, upon detecting turning off of the ignition switch of said engine.

* * * * *